US008683977B2

(12) United States Patent
Miyashita

(10) Patent No.: US 8,683,977 B2
(45) Date of Patent: Apr. 1, 2014

(54) CONTROL SYSTEM AND CONTROL METHOD FOR INTERNAL COMBUSTION ENGINE

(75) Inventor: Shigeki Miyashita, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 589 days.

(21) Appl. No.: 12/935,705

(22) PCT Filed: Apr. 8, 2009

(86) PCT No.: PCT/IB2009/005209

§ 371 (c)(1),
(2), (4) Date: Sep. 30, 2010

(87) PCT Pub. No.: WO2009/127929

PCT Pub. Date: Oct. 22, 2009

(65) Prior Publication Data

US 2011/0023829 A1 Feb. 3, 2011

(30) Foreign Application Priority Data

Apr. 14, 2008 (JP) ..... 2008-104786

(51) Int. Cl.
*F02D 43/00* (2006.01)
*F02D 13/06* (2006.01)

(52) U.S. Cl.
USPC ..... 123/445; 123/481; 123/568.16

(58) Field of Classification Search
USPC ..... 60/278, 605.2; 123/315, 65.4, 184.31, 123/472, 568.16, 568.21, 198 DB, 325, 332, 123/406.44, 406.45, 406.47; 701/103–105, 701/108, 112
See application file for complete search history.

(56) References Cited

U.S. PATENT DOCUMENTS 4,550,704 A * 11/1985 Barho et al. ..... 123/481
4,630,575 A * 12/1986 Hatamura et al. ..... 123/184.48

(Continued)

FOREIGN PATENT DOCUMENTS

DE 44 21 258 A1 12/1995
DE 10 2004 012 931 A1 10/2005

(Continued)

OTHER PUBLICATIONS

English-language translation of Oct. 5, 2012 Office Action issued in German Patent Application No. 11 2009 000 909.3.

(Continued)

*Primary Examiner* — Stephen K Cronin
*Assistant Examiner* — Elizabeth Hadley
(74) *Attorney, Agent, or Firm* — Oliff PLC

(57) ABSTRACT

In an internal combustion engine with separate cylinder banks, separate exhaust passages are connected to each cylinder bank of an engine and a shared intake passage is connected to both cylinder banks. One end of an EGR passage is connected to the separate exhaust passage of one cylinder bank, and the other end of the EGR is connected to the shared intake passage. If it is determined that an EGR valve in the EGR passage is stuck in an open state, a fuel-cut control is executed in the cylinder bank that is connected to the separate exhaust passage to which the EGR passage is connected. Thus, even when the EGR valve is stuck in an open state, it is possible to prevent the internal combustion engine from operating unstably.

8 Claims, 11 Drawing Sheets

(56) References Cited

U.S. PATENT DOCUMENTS

| | | | | |
|---|---|---|---|---|
| 5,562,086 | A * | 10/1996 | Asada et al. | 123/568.21 |
| 2006/0005811 | A1 * | 1/2006 | Hartmann | 123/406.47 |
| 2008/0072862 | A1 * | 3/2008 | Turner et al. | 123/184.42 |

FOREIGN PATENT DOCUMENTS

| | | | |
|---|---|---|---|
| DE | 10 2004 033 231 | A1 | 2/2006 |
| GB | 2 418 228 | A | 3/2006 |
| GB | 2 423 794 | A | 9/2006 |
| JP | A-11-22561 | | 1/1999 |
| JP | 2005207285 | A * | 8/2005 |
| JP | A-2005-207285 | | 8/2005 |
| JP | A-2006-97503 | | 4/2006 |

OTHER PUBLICATIONS

International Search Report dated Aug. 14, 2009 in corresponding International Application No. PCT/IB2009/005209.

Written Opinion of the International Searching Authority dated Aug. 14, 2009 in corresponding International Application No. PCT/IB2009/005209.

* cited by examiner

CONTROL SYSTEM AND CONTROL METHOD FOR INTERNAL COMBUSTION ENGINE

BACKGROUND OF THE INVENTION

1. Field of the Invention

The present invention relates to a control system for an internal combustion engine that includes a plurality of cylinder banks, and particularly, relates to a control system and a control method for an internal combustion engine that recirculates exhaust gas as EGR gas to an intake passage through an exhaust gas recirculation (EGR) passage.

2. Description of the Related Art

A technique is known that exhaust gas is introduced as EGR gas to an intake passage through an EGR passage that connects an exhaust passage with the intake passage. In this case, an amount of the EGR gas that is introduced to the intake passage through the EGR passage is regulated by controlling a degree of opening of an EGR valve that is provided in the EGR passage. Accordingly, the amount of the EGR gas that is supplied to an internal combustion engine is regulated.

If the EGR valve is stuck in an open state in the above case, an excessive amount of the EGR gas is supplied to the internal combustion engine, and thus affects a combustion state of the internal combustion engine. Consequently, the operation of the internal combustion engine may be destabilized.

Japanese Patent Application Publication No. 2005-207285 (JP-A-2005-207285) describes a technique that when an EGR valve is stuck in an open state, a cylinder cut-off operation is executed to increase an air intake amount per cylinder, thereby lowering an EGR rate. By adopting such a technique to reduce the EGR rate, it is possible to prevent affecting of the combustion state in the internal combustion engine.

However, if the amount of the EGR gas that is introduced to the intake passage is large when the EGR valve is stuck with a large opening degree, it is difficult to sufficiently reduce the EGR rate using the above technique.

SUMMARY OF THE INVENTION

The present invention provides a control system and a control method that prevents an internal combustion engine from operating unstably when an EGR valve is stuck in an open state.

In the present invention, it is presupposed to include an internal combustion engine with a plurality of cylinder banks, and when the EGR valve is stuck in an open state, fuel-cut control is executed in the cylinder bank to which EGR gas is supplied through an EGR passage that is provided with the EGR valve.

Specifically, a control system for an internal combustion engine according to a first aspect of the present invention is a control system for an internal combustion engine with a plurality of cylinder banks and includes: separate exhaust passages that are individually connected to the cylinder banks; a common intake passage that is shared by all the cylinder banks; an EGR passage whose one end is connected to one of the separate exhaust passages that is connected to one of the cylinder banks and whose other end is connected to the common intake passage; an EGR valve that is provided in the EGR passage to regulate a feed rate of EGR gas to the common intake passage; stuck-open detecting means for detecting that the EGR valve is stuck in an open state; and fuel-cut control execution means for executing a fuel-cut control in the cylinder bank with the separate exhaust passage to which the EGR passage is connected when the stuck-open detecting means detects that the EGR valve is stuck in an open state.

According to the first aspect of the present invention, the separate exhaust passages are individually connected to the cylinder banks. One end of the EGR passage is connected to one of the separate exhaust passages. Meanwhile, the other end of the EGR passage is connected to the common intake passage that is shared by all the cylinder banks. In other words, exhaust gas from the cylinder bank with the separate exhaust passage to which the EGR passage is connected (the cylinder bank is hereinafter referred to as an EGR cylinder bank) is supplied as the EGR gas to all the cylinder banks.

The EGR passage is provided with the EGR valve. The opening of the EGR valve is adjusted to regulate an amount of the EGR gas that is introduced to the common intake passage through the EGR passage, that is, the amount of the EGR gas that is supplied to all the cylinder banks.

In the first aspect of the present invention, the fuel-cut control execution means executes the fuel-cut control in the EGR cylinder bank when the stuck-open detecting means detects that the EGR valve is stuck in an open state. Here, the term "fuel-cut control" means control to stop fuel injection in each cylinder.

Because combustion is not carried out in the cylinders when the fuel-cut control is executed, no exhaust gas (burned gas) is discharged from the cylinders. Consequently, when the fuel-cut control is executed by the fuel-cut control execution means, and thus no exhaust gas is discharged from the EGR cylinder bank, the EGR gas is no longer distributed in the EGR passage. In other words, none of the cylinders is supplied with the EGR gas. Therefore, it is possible to prevent an excessive supply of the EGR gas to the internal combustion engine.

According to the first aspect of the present invention, it is possible to prevent affecting of the combustion state that can be caused by the excessive supply of the EGR gas when the EGR valve is stuck in an open state. As a result, the internal combustion engine can be prevented from unstable operation.

In the first aspect of the present invention, the internal combustion engine may be a spark-ignition internal combustion engine or a compression-ignition internal combustion engine. If the internal combustion engine is a spark-ignition internal combustion engine, a spark plug is provided in each of the cylinders. Or, if the internal combustion engine is a compression-ignition internal combustion engine, a fuel injection valve, which directly injects fuel into the cylinder, is provided in each of the cylinders.

In addition, in the first aspect of the present invention, an intake valve and an exhaust valve in the EGR cylinder bank may not be kept closed when the fuel-cut control execution means executes the fuel-cut control.

However, when the valves are open, the air is discharged from the EGR cylinder bank. Then, the air from the EGR cylinder bank is introduced to the common intake passage through the EGR passage, and part of the air flows into the cylinder bank other than the EGR cylinder bank. In other words, when the fuel-cut control execution means executes the fuel-cut control, an amount of the intake air is increased in the cylinder bank other then the EGR cylinder bank. Consequently, an excessive increase of the intake air in the cylinder bank other than the EGR cylinder bank can cause engine knock.

To solve the above problem, a delay angle may be set to retard ignition timing of the ignition plug in the cylinder bank other than the EGR cylinder bank when the fuel-cut control execution means executes the fuel-cut control under conditions that the internal combustion engine is a spark-ignition internal combustion engine and that the intake valve and the exhaust valve are not kept closed in the EGR cylinder bank during the fuel-cut control.

Alternatively, a delay angle may be set to retard fuel injection timing of the fuel injection valve in the cylinder bank other than the EGR cylinder bank when the fuel-cut control execution means executes the fuel-cut control under conditions that the internal combustion engine is a compression-ignition internal combustion engine and that the intake valve and the exhaust valve are not kept closed in the EGR cylinder bank during the fuel-cut control.

Adopting one of the above solutions prevents occurrence of engine knock that can be caused by an increase of the intake air in the cylinder bank other than the EGR cylinder bank when the fuel-cut control is executed by the fuel-cut control execution means.

The first aspect of the present invention may further include estimating means for estimating an increase amount of the intake air in the cylinder bank other than the EGR cylinder bank when the fuel-cut control execution means executes the fuel-cut control. In this case, the delay angle to retard either the ignition timing of the spark plug or the fuel injection timing of the fuel injection valve in the cylinder bank other than the EGR cylinder bank may be determined on the basis of the increase amount of the intake air that is estimated by the estimating means as described above.

Accordingly, it is possible to appropriately adjust either the ignition timing of the spark plug or the fuel injection timing of the fuel injection valve in the cylinder bank other than the EGR cylinder bank.

The first aspect of the present invention may further include valve operation controlling means for controlling operation of the intake valve and/or that of the exhaust valve in the EGR cylinder bank. In this case, when the fuel-cut control execution means executes the fuel-cut control, the intake valve and/or the exhaust valve in the EGR cylinder bank may be kept closed by the valve operation controlling means.

Accordingly, the air is prevented from flowing out of the EGR cylinder bank when the fuel-cut control execution means executes the fuel-cut control. Therefore, it is possible to prevent the excessive increase of the intake air in the cylinder bank other than the EGR cylinder bank.

In the first aspect of the present invention, an exhaust purification catalyst may further be provided in each of the separate exhaust passages. Or, the separate exhaust passages may be connected to a combined exhaust passage, and the exhaust purification catalyst may be provided in the combined exhaust passage. In the above cases, because discharge of the air from the EGR cylinder bank is prevented, it is possible to prevent cooling of the exhaust purification catalyst that is provided in either the combined exhaust passage or the separate exhaust passage connected to the EGR cylinder bank.

When the air is discharged from the EGR cylinder bank due to the fuel-cut control by the fuel-cut control execution means, the air may contain contaminants such as oil. According to the above, it is possible to prevent the contaminants from adhering to the exhaust purification catalyst that is provided in the combined exhaust passage or the separate exhaust passage connected to the EGR cylinder bank, and it is also possible to prevent the contaminants from being discharged to the outside.

A control system for an internal combustion engine according to a second aspect of the present invention is a control system for an internal combustion engine with a plurality of cylinder banks and includes: separate exhaust passages that are individually connected to the cylinder banks; separate intake passages that are individually connected to the cylinder banks; an EGR passage provided for each of the cylinder banks, whose one end is connected to the separate exhaust passage, and whose other end is connected to the separate intake passage; an EGR valve that is provided in each of the EGR passages and regulates a feed rate of EGR gas to the separate intake passage; stuck-open detecting means for detecting that one or more of the EGR valves are stuck in an open state; and fuel-cut control execution means for executing fuel-cut control in the cylinder bank with the stuck EGR valve in the EGR passage.

In the second aspect of the present invention, the separate exhaust passage and the separate intake passage are connected to each of the cylinder banks. The EGR passage is also provided for each of the cylinder banks. Therefore, exhaust gas that is discharged from one cylinder bank is supplied as the EGR gas to the same cylinder bank.

The EGR valve is provided in each of the EGR passages. An amount of the EGR gas that is introduced to each of the separate intake passages, that is, the amount of the EGR gas that is supplied to each of the cylinder banks is regulated by individually adjusting the opening of each of the EGR valves.

In the second aspect of the present invention, when the stuck-open detecting means detects that one of the EGR valves is stuck in an open state, the fuel-cut control execution means executes the fuel-cut control in the cylinder bank that is connected to the EGR passage with the stuck EGR valve (such a cylinder bank is hereinafter referred to as a cylinder bank with a stuck EGR valve).

According to the second aspect of the present invention, combustion is stopped in each of the cylinders of the cylinder bank with the stuck EGR valve in which the combustion state is possibly affected. Therefore, even when one of the EGR valves is stuck in an open state, it is possible to prevent the unstable operation of the internal combustion engine. It is also possible to prevent emissions of unburned fuel components from the cylinder bank with the stuck EGR valve.

The second aspect of the present invention may further include valve operation controlling means for controlling operation of the intake valve and/or that of the exhaust valve per cylinder bank. In this case, when the fuel-cut control execution means executes the fuel-cut control, the intake valve and/or the exhaust valve in the cylinder bank with the stuck EGR valve may be kept closed by the valve operation controlling means.

With this means, it is possible to prevent the air from flowing out of the cylinder bank with the stuck EGR valve when the fuel-cut control execution means executes the fuel-cut control.

The second aspect of the present invention may also include an exhaust purification catalyst in each of the separate exhaust passages. Or, the separate exhaust passages may be connected to a combined exhaust passage, and the exhaust purification catalyst may be provided in the combined exhaust passage. In the above cases, because the air is prevented from flowing out of the cylinder bank with the stuck EGR valve, it is possible to prevent cooling of the exhaust purification catalyst that is provided in either the combined exhaust passage or the separate exhaust passage that is connected to the cylinder bank with the stuck EGR valve.

When the air is discharged from the cylinder bank with the stuck EGR valve due to the fuel-cut control by the fuel-cut control execution means, the air may contain contaminants such as oil. According to the above, it is possible to prevent the contaminants from adhering to the exhaust purification catalyst that is provided in the combined exhaust passage or the separate exhaust passage that is connected to the cylinder bank with the stuck EGR valve, and it is also possible to prevent the contaminants from being discharged to the outside.

The third aspect of the present invention relates to a control method of an internal combustion engine. The internal combustion engine includes:

a plurality of cylinder banks;

separate exhaust passages that are individually connected to the cylinder banks;

a common intake passage that is shared by all the cylinder banks;

an EGR passage whose one end is connected to the separate exhaust passage that is connected to one of the cylinder banks and whose other end is connected to the common intake passage; and an EGR valve that is provided in the EGR passage and regulates a feed rate of EGR gas that is introduced to the common intake passage.

The control method includes: detecting that the EGR valve is stuck in an open state; and executing fuel-cut control in the cylinder bank with the separate exhaust passage to which the EGR passage is connected when the EGR valve is detected to be stuck in an open state.

The third aspect of the present invention has the same effects as the first aspect of the present invention, and thus when the EGR valve is stuck in an open state, it is possible to prevent affecting of the combustion state that can be caused by an excessive supply of the EGR gas. As a result, unstable operation of the internal combustion engine can be prevented.

According to the present invention, even when the EGR valve is stuck in an open state, it is possible to prevent the unstable operation of the internal combustion engine.

BRIEF DESCRIPTION OF THE DRAWINGS

The foregoing and further features and advantages of the invention will become apparent from the following description of example embodiments with reference to the accompanying drawings, wherein like numerals are used to represent like elements, and wherein.

DETAILED DESCRIPTION OF EMBODIMENTS

Specific embodiments of a control system for an internal combustion engine according to the present invention will be described below with reference to the drawings. The present invention is applied to an automotive internal combustion engine in the following embodiments.

Figure 1:
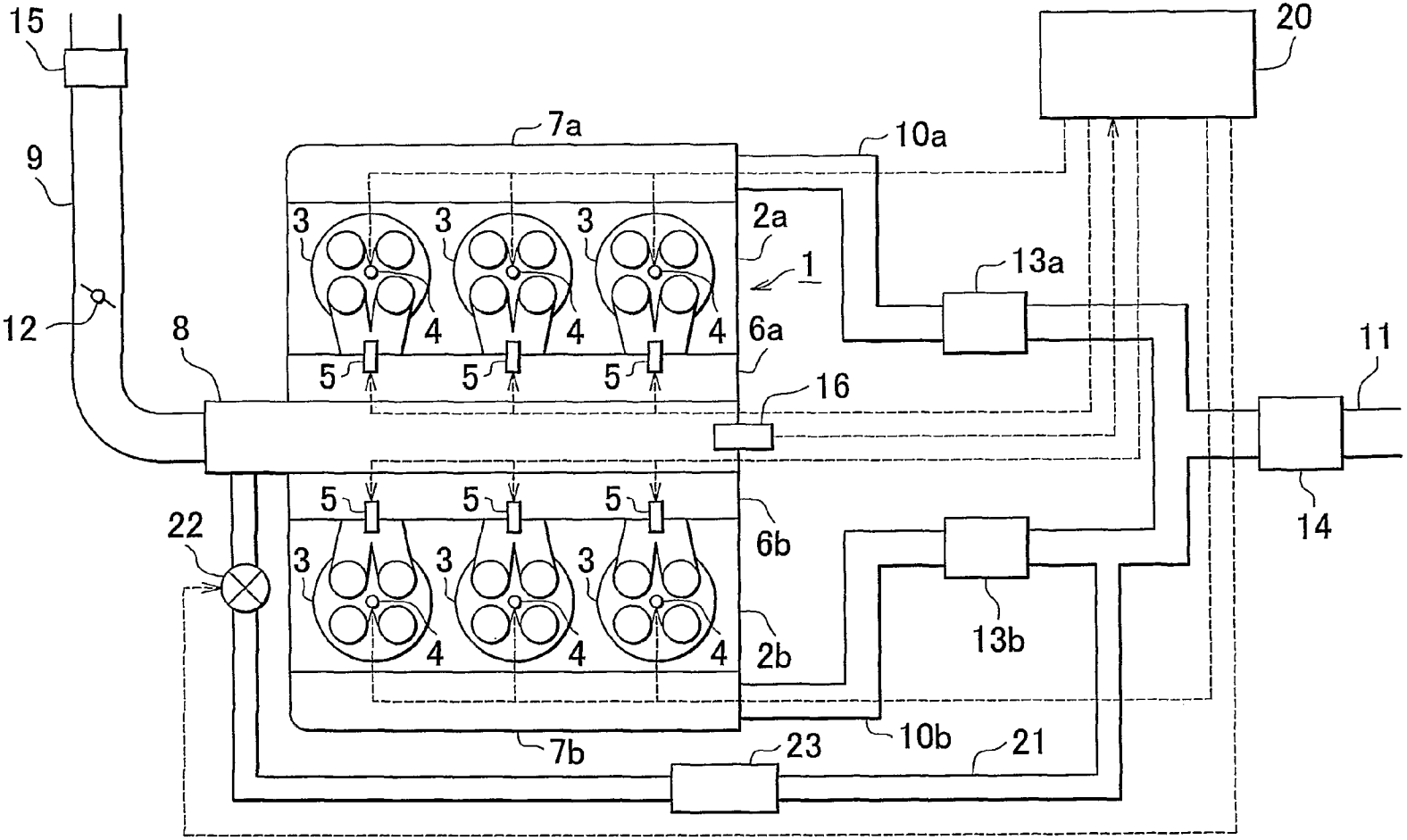
FIG. 1 is a diagram showing a schematic structure of an internal combustion engine and its intake and exhaust systems in accordance with a first embodiment of the present invention.

FIG. 1 is a diagram showing a schematic structure of the internal combustion engine and its intake and exhaust systems in accordance with a first embodiment of the present invention. An internal combustion engine 1 in the first embodiment is a V6 gasoline engine (spark-ignited internal combustion engine) with two cylinder banks 2*a* and 2*b*, each of which includes three cylinders 3. The cylinder bank 2*a* is hereinafter referred to as a first cylinder bank 2*a*, and the cylinder bank 2*b* is referred to as a second cylinder bank 2*b*.

It should be noted that the number of cylinders, the number of cylinder banks, and their arrangements in the internal combustion engine 1 are not restricted to the above configuration.

A spark plug 4 is provided in each cylinder 3 of the cylinder banks 2*a* and 2*b*. A fuel injection valve 5 is also provided in an intake port of each cylinder 3.

The first cylinder bank 2*a* is connected with a first intake manifold 6*a* and a first exhaust manifold 7*a*. The second cylinder bank 2*b* is connected with a second intake manifold 6*b* and a second exhaust manifold 7*b*.

Both of the first and second intake manifolds 6*a* and 6*b* are connected to a surge tank 8. In the surge tank 8, a pressure sensor 16 is provided to detect pressure in the surge tank 8.

An intake passage 9 is connected to the surge tank 8. The intake passage 9 is provided with an airflow meter 15 and a throttle valve 12.

A separate exhaust passage 10*a* is connected to the first exhaust manifold 7*a*, and a separate exhaust passage 10*b* is connected to the second exhaust manifold 7*b*. The separate exhaust passage 10*a* is hereinafter referred to as a first separate exhaust passage 10*a*, and the separate exhaust passage 10*b* is referred to as a second separate exhaust passage 10*b*. The downstream ends of the first and second separate exhaust passages 10*a* and 10*b* are connected to a combined exhaust passage 11.

A three-way catalyst 13*a* is provided in the first separate exhaust passage 10*a*, and a three-way catalyst 13*b* is provided in the second separate exhaust passage 10*b*. A three-way catalyst 14 is also provided in the combined exhaust passage 11.

Alternatively, the first and second separate exhaust passages 10*a* and 10*b* may not necessarily be connected to the combined exhaust passage 11, and the downstream ends of the first and second separate exhaust passages 10*a* and 10*b* may be individually arranged. In addition, another catalyst (an oxidation catalyst, a NOx storage-reduction catalyst, etc.)

that is appropriately selected for the purpose of exhaust purification may be provided instead of the three-way catalysts 13*a*, 13*b*, and 14.

Furthermore, one end of an EGR passage 21 is connected to a section of the second separate exhaust passage 10*b* that is downstream of the three-way catalyst 13*b*. The other end of the EGR passage 21 is connected to the surge tank 8. The EGR passage 21 is provided with an EGR valve 22 and an EGR cooler 23. Here, the other end of the EGR passage 21 may be connected to a section of the intake passage 9 that is downstream of the throttle valve 12.

The internal combustion engine 1 according to the first embodiment is equipped with an electronic control unit (ECU) 20 that controls the internal combustion engine 1. The airflow meter 15 and the pressure sensor 16 are electrically connected to the ECU 20. Then, output signals from these components are input to the ECU 20.

The ignition plugs 4, the fuel injection valves 5, the throttle valve 12, and the EGR valve 22 are also electrically connected to the ECU 20. The ECU 20 controls these components.

As described above, in the first embodiment, one end of the EGR passage 21 is connected to the second separate exhaust passage 10*b*, and the other end of the EGR passage 21 is connected to the surge tank 8. Thus, exhaust gas that flows through the second separate exhaust passage 10*b*, that is, the exhaust gas that is discharged from the second cylinder bank 2*b* is introduced as EGR gas to the surge tank 8 through the EGR passage 21. Then, the EGR gas that is introduced to the surge tank 8 flows into the first cylinder bank 2*a* through the first intake manifold 6*a* and also into the second cylinder bank 2*b* through the second intake manifold 6*b*.

The degree of opening of the EGR valve 22 is adjusted to regulate an amount of the EGR gas that is introduced to the surge tank 8 through the EGR passage 21. In other words, the amount of the EGR gas that flows into the first and second cylinder banks 2*a* and 2*b* is regulated by adjusting the degree of opening of the EGR valve 22. Generally, the degree of opening of the EGR valve 22 is adjusted so that the amount of the EGR gas, which flows into the first and second cylinder banks 2*a* and 2*b*, is optimized for the operating state of the internal combustion engine 1.

However, if the EGR valve 22 becomes abnormally stuck in an open state, it becomes difficult to regulate the amount of EGR gas that flows into the first and second cylinder banks 2*a* and 2*b*. Consequently, if the amount of the EGR gas that flows into the first and second cylinder banks 2*a* and 2*b* is excessive for the operating state of the internal combustion engine 1, the combustion state in each cylinder 3 may be affected. As described above, if the combustion state is affected by the excessive amount of the EGR gas, it can cause misfires and torque fluctuations that result in the unstable operation of the internal combustion engine 1 and an increase in emissions of unburned fuel components.

For the above reason, if the EGR valve 22 of the first embodiment is stuck in an open state, the fuel-cut control is executed in the second cylinder bank 2*b*.

When the fuel-cut control is executed in the second cylinder bank 2*b*, combustion ceases in all the cylinders 3 of the second cylinder bank 2*b*. Thus, the exhaust gas (burned gas) does not flow into the second separate exhaust passage 10*b* and the EGR passage 21. In other words, the surge tank 8 is not supplied with the EGR gas. As a result, the EGR gas is not supplied to the first and second cylinder banks 2*a* and 2*b*. Therefore, it is possible to prevent the excessive supply of the EGR gas in the internal combustion engine 1.

In the first aspect of the present invention, when the EGR valve 22 is stuck in an open state, it is possible to prevent affecting of the combustion state in the internal combustion engine 1 that can be caused by the excessive supply of the EGR gas. Therefore, it is possible to prevent misfires and torque fluctuations, and thus it is possible to prevent the unstable operation of the internal combustion engine 1. The increased emissions of unburned fuel components are also prevented.

Even when the fuel-cut control is executed in the second cylinder bank 2*b*, required torque for the internal combustion engine 1 may be secured by executing appropriate controls such as by increasing the fuel injection amount in the first cylinder bank 2*a*.

Figure 2:
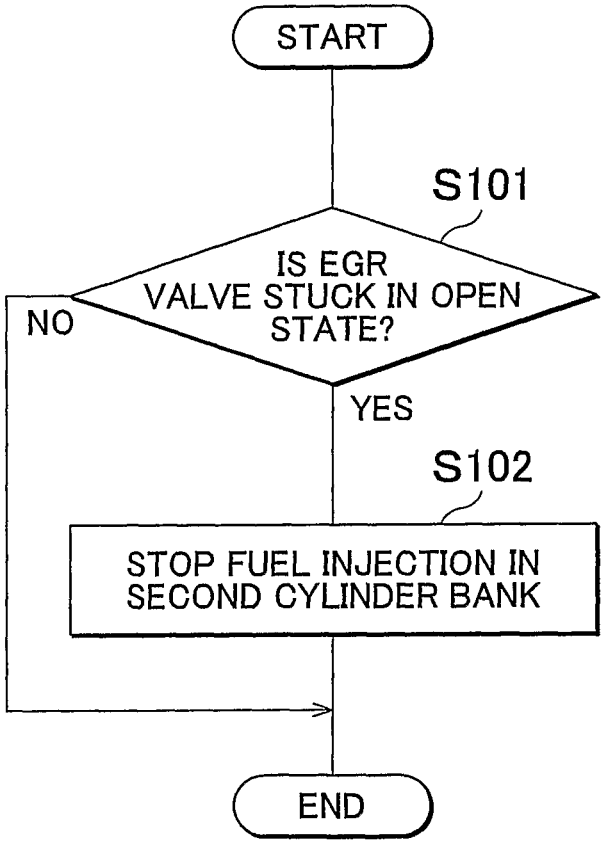
FIG. 2 is a flowchart showing control routine when an EGR valve according to the first embodiment is stuck in an open state.

Based on the flowchart shown in FIG. 2, description is now made on control routine that is executed when the EGR valve 22 is stuck in an open state in the first embodiment. The routine is stored in advance in the ECU 20 and executed repetitively at predetermined intervals during the operation of the internal combustion engine 1.

In step S101 of the routine, the ECU 20 determines whether the EGR valve 22 is stuck in the open state. In this step, based on a value detected by the pressure sensor 16, the ECU 20 determines whether the EGR valve 22 is stuck in the open state.

If the EGR 22 is stuck in the open state and thus more than a desired amount of the EGR gas, which is suited for the operating state of the internal combustion engine 1, flows into the surge tank 8, pressure in the surge tank 8 becomes higher than that with the desired amount of the EGR gas. Therefore, it is possible to determine whether the EGR valve 22 is stuck in the open state on the basis of the value detected by the pressure sensor 16.

If the condition is true in step S101, the ECU 20 proceeds to step S102, and if the condition is false, the ECU 20 temporarily ends the routine.

In step S102, the ECU 20 stops fuel injection by the fuel injection valves 5 in the second cylinder bank 2*b*. In other words, the fuel-cut control is executed in the second cylinder bank 2*b*. Then, the ECU 20 temporarily ends the routine.

In the first embodiment, the first and second separate exhaust passages 10*a* and 10*b* may be regarded as the separate exhaust passages according to the first aspect of the present invention. Also, in the first embodiment, the surge tank 8 and a section of the intake passage 9 that is downstream of the throttle valve 12 may be regarded as the common intake passage according to the first aspect of the present invention.

In the first embodiment, the above-described ECU 20 that executes step S101 of the control routine when the EGR valve 22 is stuck in the open state may be regarded as the stuck-open detecting means according to the first aspect of the present invention. In step S101, a method other than the above may be used to determine whether the EGR 22 is stuck in the open state. For example, an opening sensor may be provided to detect the degree of opening of the EGR valve 22, and it may be determined whether the EGR valve 22 is stuck in the open state based on opening degree detected by the opening sensor. Alternatively, a temperature sensor may be provided to detect a temperature in the surge tank 8, and it may be determined whether the EGR valve 22 is stuck in the open state based on the temperature detected by the temperature sensor.

In the first embodiment, the above-described ECU 20 that executes step S102 of the control routine when the EGR valve 22 is stuck in an open state may be regarded as the fuel-cut control means according to the first aspect of the present invention.

Even if the internal combustion engine 1 is a compression-ignition internal combustion engine (diesel engine), the above-described control may also be applied thereto when the EGR valve 22 is stuck in an open state.

A schematic structure of an internal combustion engine and its intake and exhaust systems according to the second embodiment are the same as those in the first embodiment.

In the second embodiment, if the EGR valve 22 becomes abnormally stuck in an open state, the fuel-cut control is executed in the second cylinder bank 2*b*, just as in the first embodiment. When the fuel-cut control is executed, the intake valve and the exhaust valve for each cylinder 3 of the second cylinder bank 2*b* function normally (that is, as if the fuel-cut control is not executed). In other words, the intake and exhaust valve for each cylinder 3 of the second cylinder bank 2*b* are not kept closed.

In this case, the air is discharged from the second cylinder bank 2*b*. Then, the air from the second cylinder bank 2*b* is introduced to the surge tank 8 through the EGR passage 21, and part of the air flows into the first cylinder bank 2*a*. In other words, if the fuel-cut control is executed in the second cylinder bank 2*b*, the amount of intake air is increased in the first cylinder bank 2*a*. Consequently, the excessive increase of the intake air in the first cylinder bank 2*a* may cause engine knock.

For the above reason, in the second embodiment, a delay angle is set to delay the ignition timing of each of the ignition plugs 4 in the first cylinder bank 2*a* when the EGR valve 22 is stuck in an open state and thus the fuel-cut control is executed in the second cylinder bank 2*b*.

Therefore, it is possible to prevent engine knock that is caused by the increase of the intake air in the first cylinder bank 2*a*.

Figure 3:
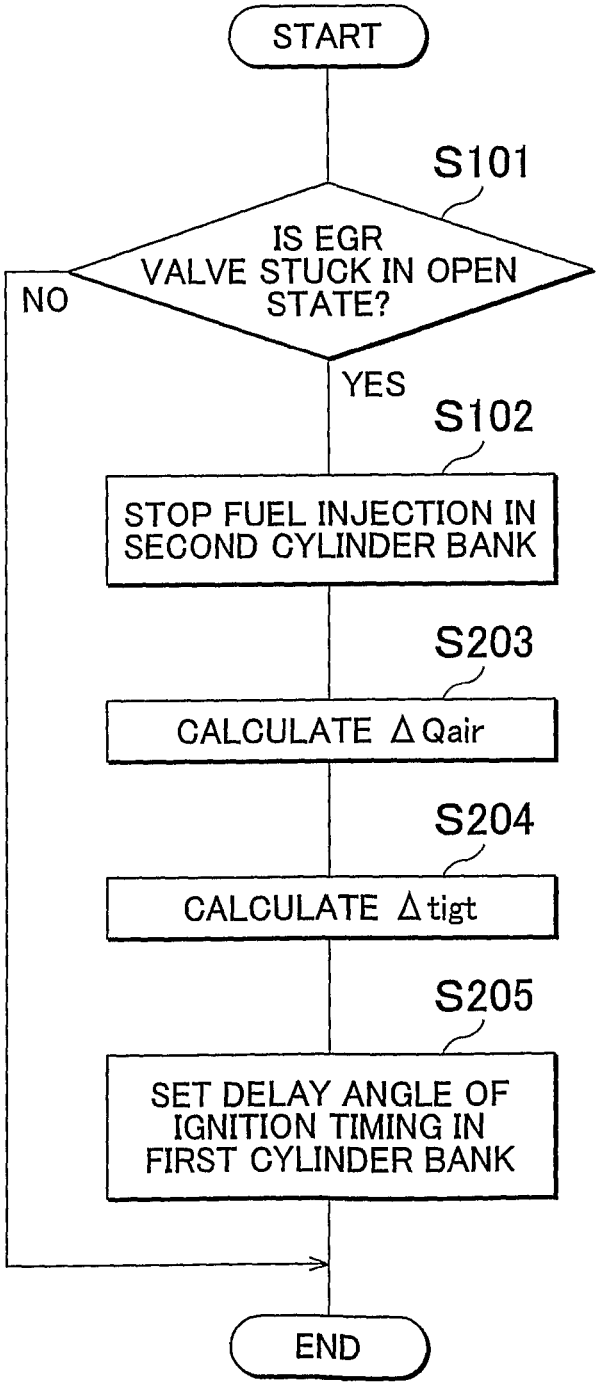
FIG. 3 is a flowchart showing control routine when an EGR valve according to a second embodiment is stuck in an open state.

Based on the flowchart shown in FIG. 3, description is now made on control routine that is executed when the EGR valve 22 is stuck in an open state in the second embodiment. The routine is stored in advance in the ECU 20 and executed repetitively at predetermined intervals during the operation of the internal combustion engine 1. In this routine, steps S203 to S205 are added to the routine in FIG. 2. Therefore, the steps that are also shown in FIG. 2 will no be described again.

In the routine, after the fuel-cut control is executed in the second cylinder bank 2*b* in step S102, the ECU 20 proceeds to step S203. In step S203, based on a pressure detected by the pressure sensor 16, the ECU 20 calculates an increased amount of the intake air in the first cylinder bank 2*a*, ΔQair, in a time period that starts prior to the fuel-cut control in the second cylinder bank 2*b*.

When the fuel-cut control is executed in the second cylinder bank 2*b*, and thus the air is introduced to the surge tank 8 through the EGR 21 instead of the EGR gas, the pressure in the surge tank 8 changes in accordance with the amount of the air that is introduced to the surge tank 8. Therefore, the increased amount of the intake air in the first cylinder bank 2*a*, ΔQair, may be calculated based on the pressure detected by the pressure sensor 16.

Next, the process proceeds to step S204, and the ECU 20 calculates a target delay angle of the ignition timing in the first cylinder bank 2*a*, Δtigt, based on the increased amount of the intake air in the first cylinder bank 2*a*, ΔQair calculated in step S203.

Here, the target delay angle Δtigt is a delay angle to retard the ignition timing for a period that is long enough to prevent engine knock even when the air in the first cylinder bank 2*a* is increased by the increased amount ΔQair. The correlation between the increased amount of the intake air in the first cylinder bank 2*a*, ΔQair, and the target delay angle of the ignition timing in the first cylinder bank 2*a*, Δtigt, may be determined empirically. In the second embodiment, the correlation is stored in advance as a map in the ECU 20.

Next, the process proceeds to step S205, and the ECU 20 retards the ignition timing of each ignition plug 4 in the first cylinder bank 2*a* for the target delay angle, Δtigt, which is calculated in step S204. Then, the ECU 20 temporarily ends the routine.

According to the routine that is described above, the target delay angle, which is used to retard the ignition timings in the first cylinder bank 2*a*, is determined based on the increased amount of the intake air in the first cylinder bank 2*a* as a result of the fuel-cut control executed in the second cylinder bank 2*b*. Therefore, the ignition timings in the first cylinder bank 2*a* may be set appropriately. In other words, it is possible to prevent engine knock more reliably.

It should be noted that the delay angle, which is used to retard the ignition timings in the first cylinder bank 2*a*, may be set differently from the above. For example, the target delay angle may be set to a given constant value when it is difficult to calculate the increased amount of the intake air in the first cylinder bank 2*a*, which results from the execution of the fuel-cut control in the second cylinder bank 2*b*. In this case, contrary to a case where a delay angle is not set for the ignition timings in the first cylinder bank 2*a*, it is possible to prevent engine knock when the fuel-cut control is executed in the second cylinder bank 2*b*.

In the second embodiment, the above-mentioned ECU 20 that executes step S203 of the control routine when the EGR valve 22 is stuck in an open state may be regarded as the estimating means according to the first aspect of the present invention. In step S203, a method other than the above may be used to calculate the increased amount of the intake air in the first cylinder bank 2*a*. For example, if an opening sensor is provided to detect the degree of opening of the EGR valve 22, the increased amount of the intake air in the first cylinder bank 2*a* may be calculated based on the degree of opening detected by the opening sensor. Alternatively, if a temperature sensor is provided to detect a temperature in the surge tank 8, the increased amount of the intake air in the first cylinder bank 2*a* may be calculated based on the temperature detected by the temperature sensor.

Figure 4:
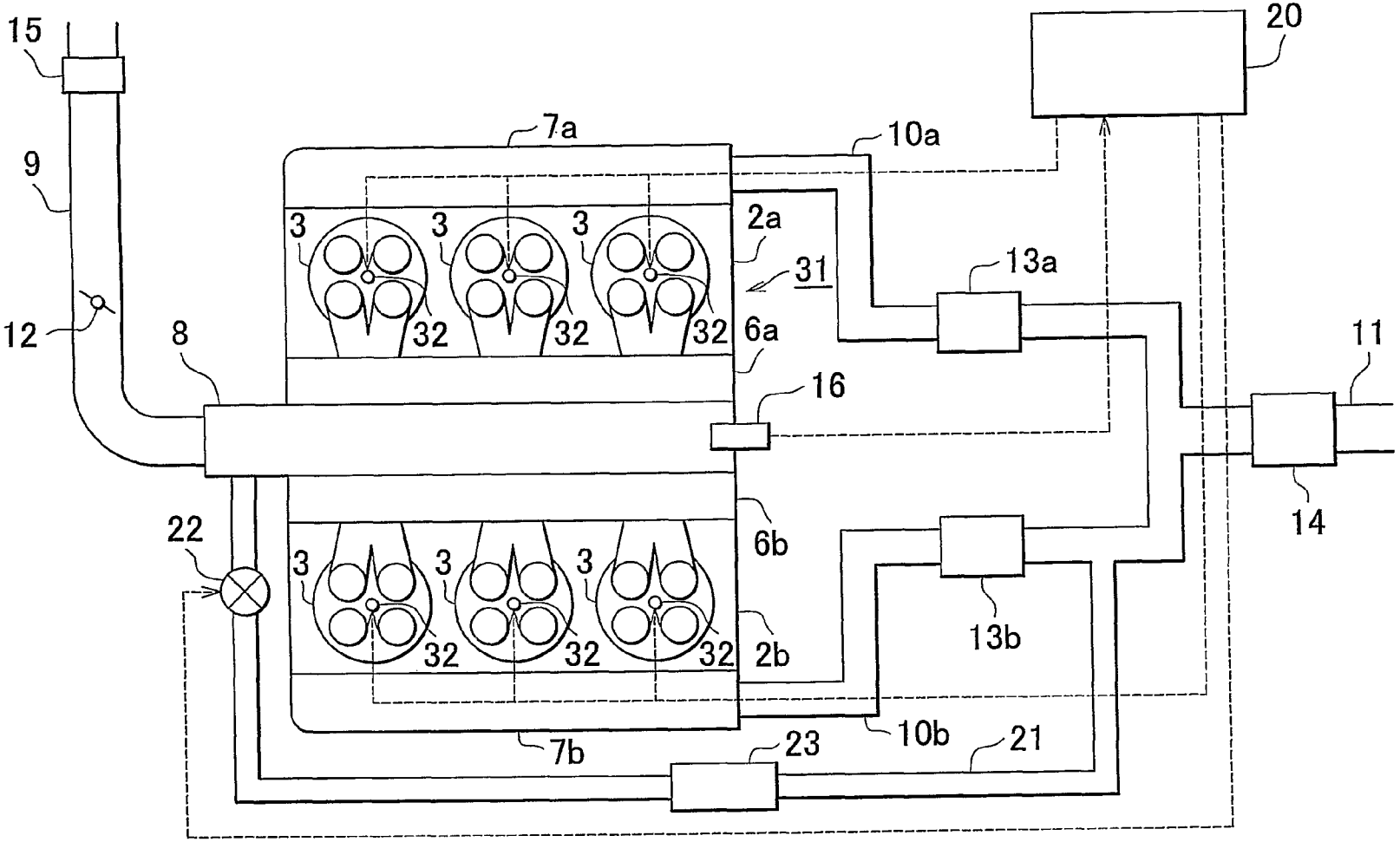
FIG. 4 is a diagram showing a schematic structure of an internal combustion engine and its intake and exhaust systems in accordance with a third embodiment of the present invention.

FIG. 4 shows a schematic structure of the internal combustion engine and its intake and exhaust systems in accordance with a third embodiment of the present invention. An internal combustion engine 31 in the third embodiment is a V6 diesel engine (compression-ignited internal combustion engine).

In the internal combustion engine 31, instead of the ignition plugs 4 and the fuel injection valves 5 in the internal combustion engine 1 that are shown in FIG. 1, a fuel injection valve 32 is provided in each cylinder 3 to directly inject fuel into the cylinder 3. Each fuel injection valve 32 is electrically connected to and controlled by the ECU 20. The other structure is the same as those shown in FIG. 1.

In addition, in the third embodiment, when the EGR valve 22 is abnormally stuck in open state, fuel injection from each fuel injection valve 31 in the second cylinder bank 2*b* is stopped, and then the fuel-cut control is executed in the second cylinder bank 2*b* as in the first embodiment. At this time, the intake valve and the exhaust valve in each cylinder 3 of the second cylinder bank 2*b* function normally (that is, as if the fuel-cut control is not executed) as in the second embodiment. In other words, the intake and exhaust valves in each cylinder 3 of the second cylinder bank 2*b* do not remain closed.

In this case, as described above, the amount of the intake air is increased in the first cylinder bank 2*a*. Consequently, the excessive increase of the intake air in the first cylinder bank 2*a* may cause engine knock in the internal combustion engine 31, which is a diesel engine.

For the above reason, in the third embodiment, a delay angle is set to retard fuel injection timing of each of the fuel injection valves 32 in the first cylinder bank 2*a* when the EGR valve 22 is stuck in an open state and thus the fuel-cut control is executed in the second cylinder bank 2*b*.

Therefore, it is possible to prevent engine knock that may result from the increase of the amount of intake air in the first cylinder bank 2*a*.

Figure 5:
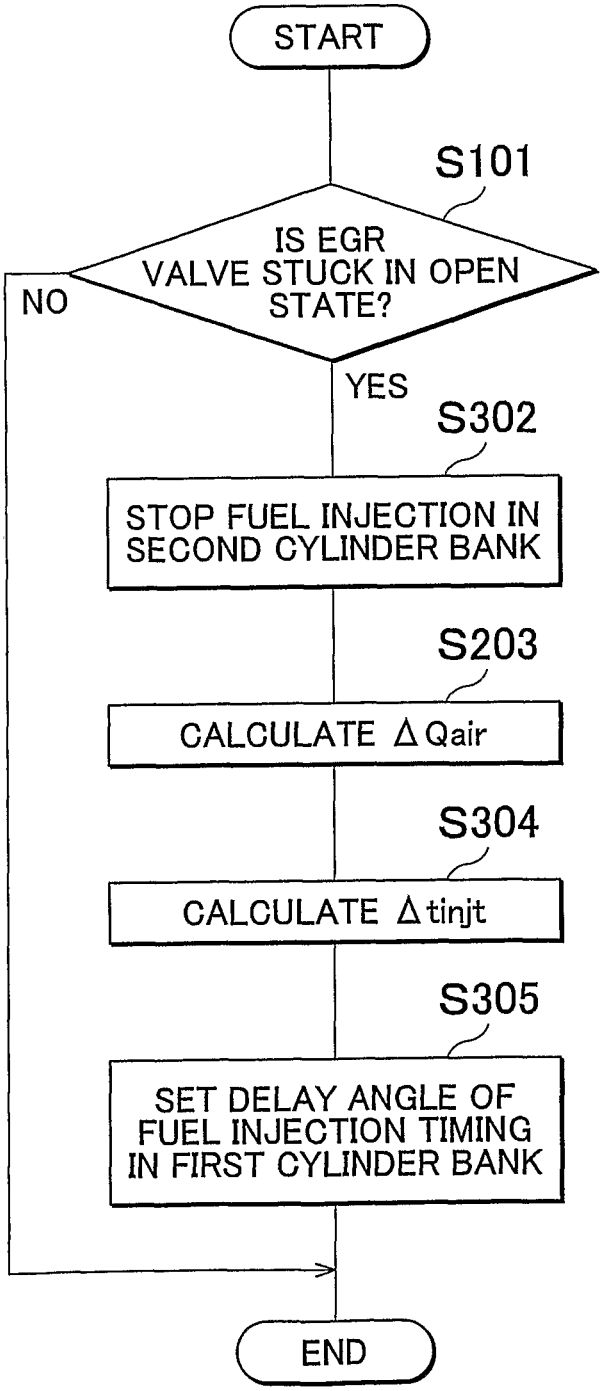
FIG. 5 is a flowchart showing control routine when an EGR valve according to the third embodiment is stuck in an open state.

Based on the flowchart shown in FIG. 5, the control routine that is executed in the third embodiment when the EGR valve 22 is stuck in an open state will now be described. The routine is stored in advance in the ECU 20 and executed repetitively at predetermined intervals during the operation of the internal combustion engine 31. The steps S102, S204, and S205 in the routine shown in FIG. 3 are respectively changed to steps S302, S304, and S305 in this routine. Therefore, the steps that are also shown in FIG. 3 will not be described again.

In the routine, the ECU 20 proceeds to step S302 if the condition in step S101 is true. In step S302, the ECU 20 stops fuel injection by the fuel injection valves 32 in the second cylinder bank 2*b*. In other words, the fuel-cut control is executed in the second cylinder bank 2*b*.

In the routine, the ECU 20 proceeds to step S304 upon completion of step S203. In step S304, the ECU 20 calculates a target delay angle of the fuel injection timing in the first cylinder bank 2*a*, Δtinjt, based on the increased amount of the intake air in the first cylinder bank 2*a*, ΔQair, which is calculated in step S203.

Here, the target delay angle Δtinjt is a delay angle to retard the fuel injection timing for a period that is sufficient to prevent engine knock even when the air in the first cylinder bank 2*a* is increased by the increased amount ΔQair. The correlation between the increased amount of the intake air in the first cylinder bank 2*a*, ΔQair, and the target delay angle of the fuel injection timing in the first cylinder bank 2*a*, Δtinjt, may be empirically determined. In the third embodiment, the correlation is stored in advance as a map in the ECU 20.

Next, the process proceeds to step S305, and the ECU 20 retards the fuel injection timing of each fuel injection valve 32 in the first cylinder bank 2*a* for the target delay angle Δtinjt, which is calculated in step S304. Then, the ECU 20 temporarily ends the routine.

According to the routine that is described above, the target delay angle, which is used to retard the fuel injection timings in the first cylinder bank 2*a*, is determined by the increased amount of the intake air in the first cylinder bank 2*a* that results from the execution of the fuel-cut control in the second cylinder bank 2*b*. Therefore, the fuel injection timings in the first cylinder bank 2*a* may be set appropriately. In other words, it is possible to prevent engine knock more reliably.

However, in the third embodiment, the delay angle, which is used to retard the fuel injection timings in the first cylinder bank 2*a*, may be set differently from the above. For example, the target delay angle may be set to a given constant value when it is difficult to calculate the increased amount of the intake air in the first cylinder bank 2*a*, which results from the execution of the fuel-cut control in the second cylinder bank 2*b*. Contrary to a case where a delay angle is not set for the fuel injection timings in the first cylinder bank 2*a*, it is possible in this case to prevent engine knock when the fuel-cut control is executed in the second cylinder bank 2*b*.

Figure 6:
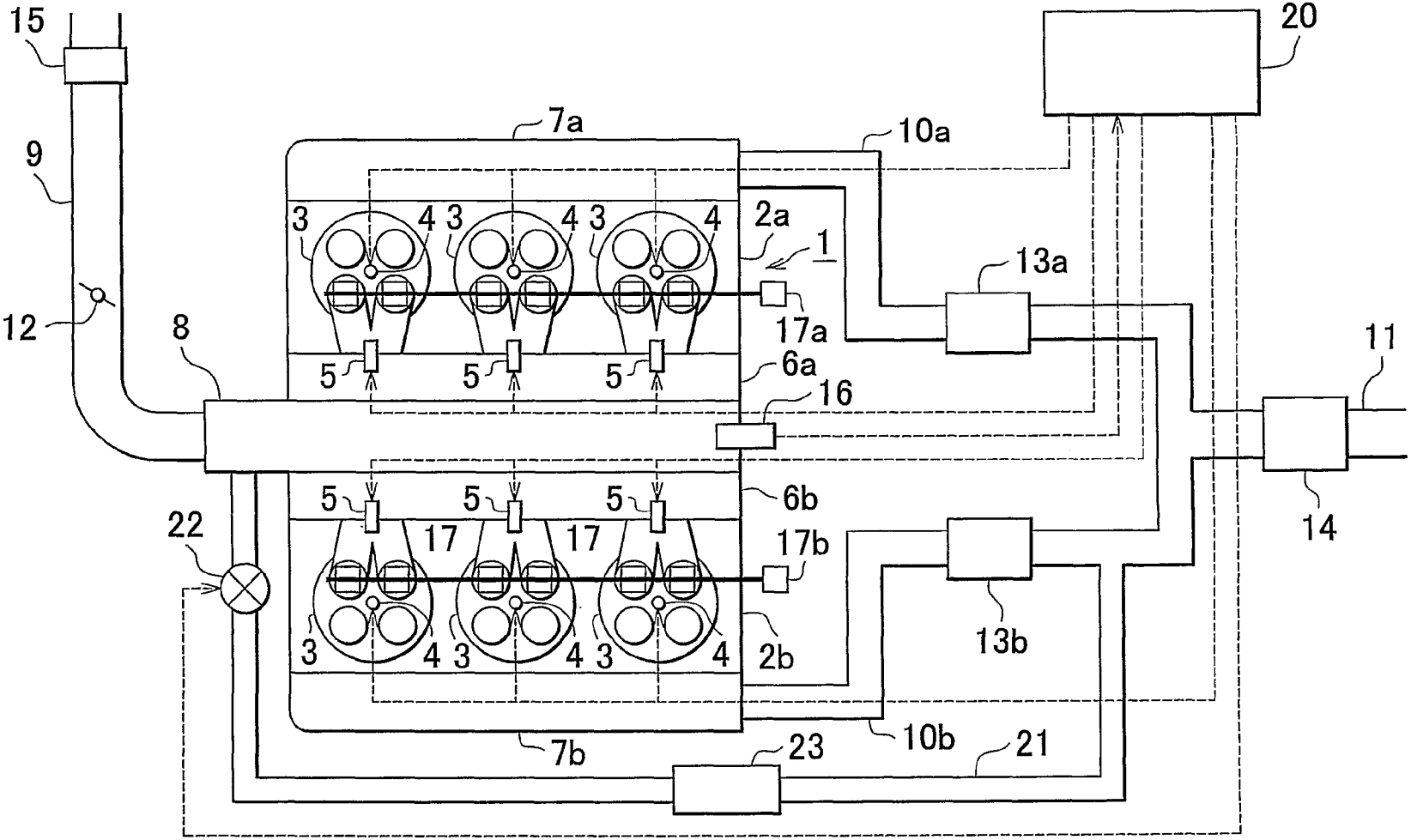
FIG. 6 is a diagram showing a schematic structure of an internal combustion engine and its intake and exhaust systems in accordance with a fourth embodiment of the present invention.

FIG. 6 shows a schematic structure of the internal combustion engine and its intake and exhaust systems in accordance with a fourth embodiment of the present invention. In the internal combustion engine 1 according to the fourth embodiment, a first and a second valve driving mechanisms 17*a* and 17*b* that can change valve timing of the intake valves are respectively provided in the first and second cylinder banks 2*a* and 2*b*. Each of the valve driving mechanisms 17*a* and 17*b* is electrically connected to and controlled by the ECU 20. The other structure is the same as those in the first embodiment.

Here, the first and second valve driving mechanisms 17*a* and 17*b* may be illustrated as a mechanism that independently rotates a camshaft, which operates the intake valves, from a crankshaft by a motor.

Also in the fourth embodiment, when the EGR valve 22 is abnormally stuck in the open state, fuel injection from each of the fuel injection valves 5 in the second cylinder bank 2*b* is stopped, and then the fuel-cut control is executed in the second cylinder bank 2*b* as in the first embodiment. At this time, in the fourth embodiment, the second valve driving mechanism 17*b* closes the intake valves in the cylinders 3 of the second cylinder bank 2*b* and the intake valves remain closed.

Accordingly, it is possible to prevent the air from flowing out of the second cylinder bank 2*b* when the fuel-cut control is executed. Therefore, it is possible to prevent the excessive increase of the intake air in the first cylinder bank 2*a*. As a result, engine knock can be prevented.

In addition, when the fuel-cut control is executed, and thus the air is discharged from the second cylinder bank 2*b*, the air may cool the three-way catalysts 13*b* and 14. However, according to the fourth embodiment, such cooling of the three-way catalysts 13*b* and 14 may be prevented.

Furthermore, when the air is discharged from the second cylinder bank 2*b* due to the fuel-cut control, the air may contain contaminants such as oil. However, according to the fourth embodiment, it is possible to prevent emissions of such contaminants from the second cylinder bank 2*b*. Therefore, it is possible to prevent the contaminants from adhering to the three-way catalysts 13*b* and 14 and from being discharged to the outside.

Figure 7:
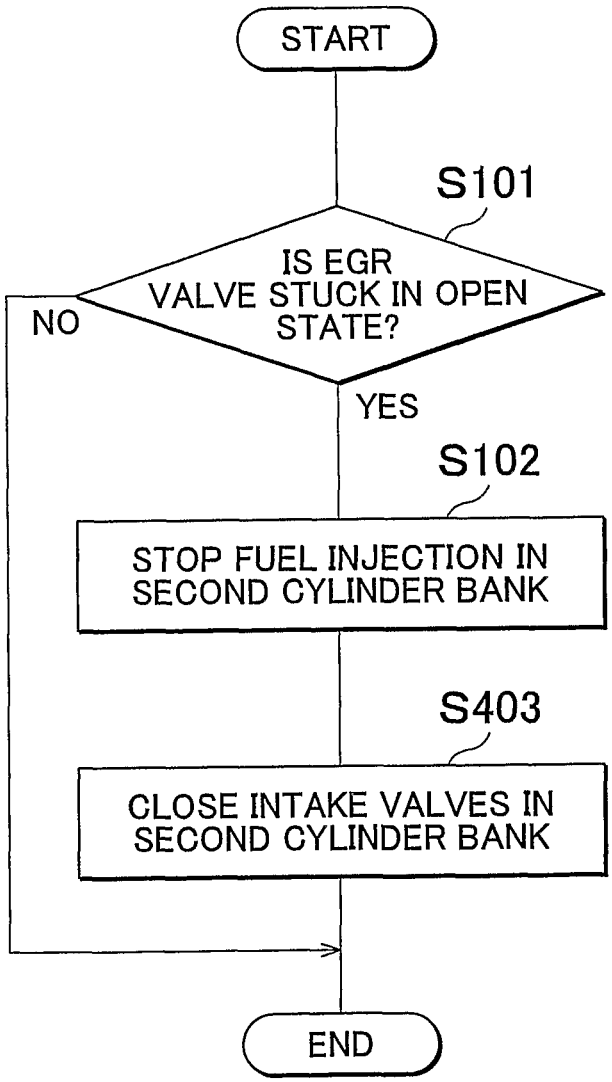
FIG. 7 is a flowchart showing control routine when an EGR valve according to the fourth embodiment is stuck in an open state.

Based on the flowchart shown in FIG. 7, the control routine that is executed when the EGR valve 22 is stuck in an open state in the fourth embodiment will be described. The routine is stored in advance in the ECU 20 and executed repetitively at predetermined intervals during the operation of the internal combustion engine 1. In this routine, step S403 is added to the routine in FIG. 2. Therefore, description of the steps that are also shown in FIG. 2 is not repeated.

In the routine, after the fuel-cut control is executed in the second cylinder bank 2*b* in step S102, the ECU 20 proceeds to step S403. In step S403, the ECU 20 closes the intake valves in the cylinders 3 of the second cylinder bank 2*b* by the second valve driving mechanism 17*b*. Then, the ECU 20 temporarily ends the routine.

The second valve driving mechanism 17*b* in the fourth embodiment may be regarded as the valve operation controlling means according to the first aspect of the present invention. Also in the fourth embodiment, instead of the first and second valve driving mechanisms 17*a* and 17*b* that change the valve timing of the intake valves, a valve driving mechanism that changes valve timing of the exhaust valves may be provided for each cylinder bank 2*a* and 2*b*. Thus, when the fuel-cut control is executed in the second cylinder bank 2*b*, the exhaust valves in the second cylinder bank 2*b* may be kept closed. In this case, the valve driving mechanism that changes the valve timing of the exhaust valves in the second cylinder bank 2*b* may be regarded as the valve operation controlling means according to the first aspect of the present invention.

Also in the fourth embodiment, in addition to the first and second valve driving mechanisms 17*a* and 17*b* that change the valve timing of the intake valves, the valve driving mechanism that changes the valve timing of the exhaust valves may be provided for each cylinder bank 2*a* and 2*b*. Thus, if the fuel-cut control is executed in the second cylinder bank 2*b*, both the intake valves and the exhaust valves of the second cylinder bank 2*b* may be kept closed. In this case, the second valve driving mechanism 17*b* that changes the valve timing of the intake valves in the second cylinder bank 2*b* and the valve driving mechanism that changes the valve timing of the exhaust valves in the second cylinder bank 2*b* may be regarded as the valve operation controlling means according to the first aspect of the present invention.

Figure 8:
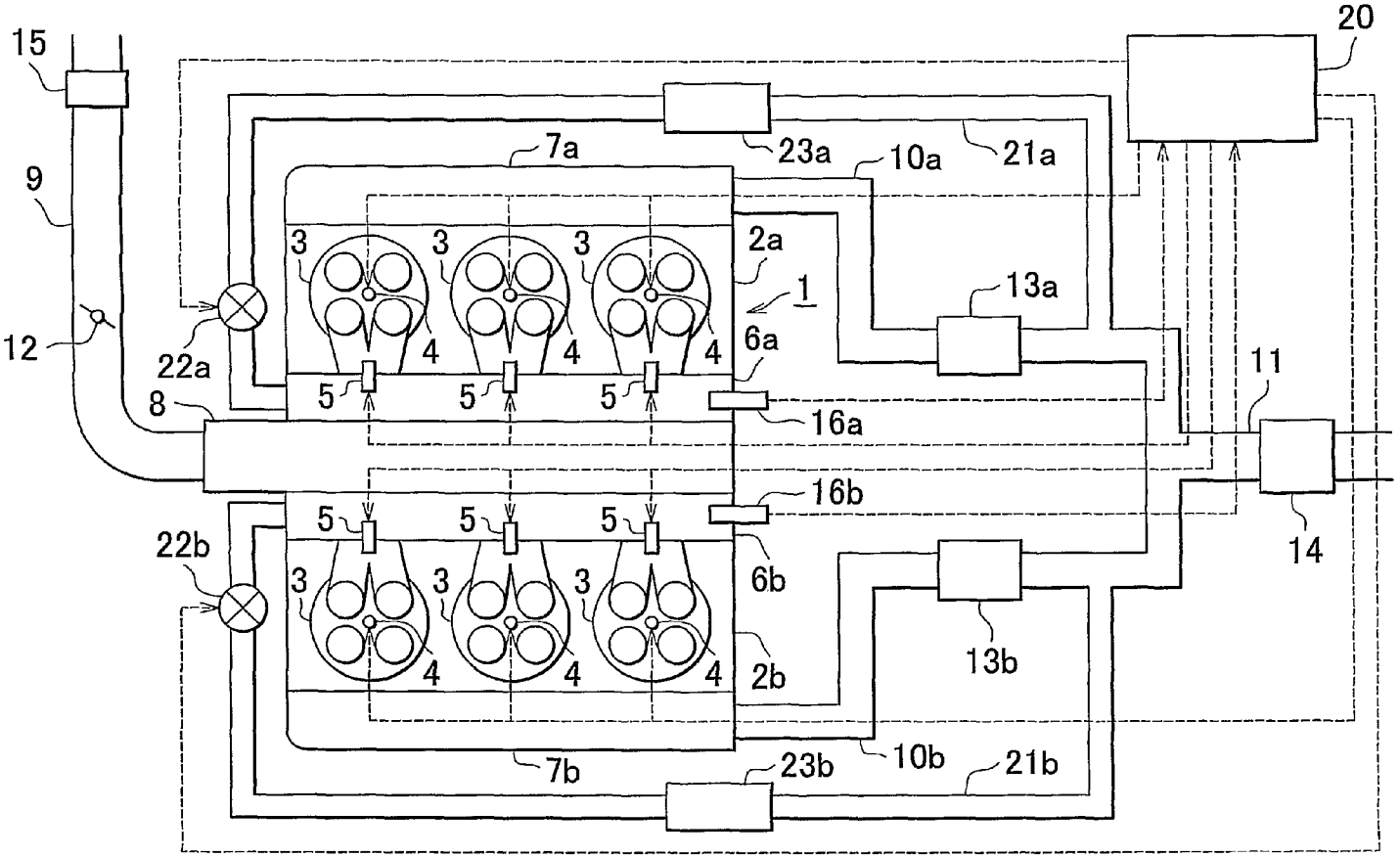
FIG. 8 is a diagram showing a schematic structure of an internal combustion engine and its intake and exhaust systems in accordance with a fifth embodiment of the present invention.

FIG. 8 shows a schematic structure of the internal combustion engine and its intake and exhaust systems in accordance with a fifth embodiment of the present invention. Instead of the EGR passage 21 in the first embodiment, the fifth embodiment is provided with EGR passages 21*a* and 21*b* that respectively correspond to the cylinder banks 2*a* and 2*b*. The EGR passage 21*a* that corresponds to the first cylinder bank 2*a* is hereinafter referred to as a first EGR passage 21*a*, and the EGR passage 21*b* that corresponds to the second cylinder bank 2*b* is referred to as a second EGR passage 21*b*.

One end of the first EGR passage 21*a* is connected to a section of the first separate exhaust passage 10*a* that is downstream of the three-way catalyst 13*a* while the other end thereof is connected to the first intake manifold 6*a*. Meanwhile, one end of the second EGR passage 21*b* is connected to a section of the second separate exhaust passage 10*b* that is downstream of the three-way catalyst 13*b* while the other end thereof is connected to the second intake manifold 6*b*.

A first EGR valve 22*a* and a first EGR cooler 23*a* are provided in the first EGR passage 21*a*. A second EGR valve 22*b* and a second EGR cooler 23*b* are provided in the second EGR passage 21*b*.

The EGR valves 22*a* and 22*b* are electrically connected to and individually controlled by the ECU 20.

Furthermore, in the fifth embodiment, instead of the pressure sensor 16 in the first embodiment, pressure sensors 16*a* and 16*b* that detect pressure in the first and second intake manifolds 6*a* and 6*b*, respectively, are respectively provided in the first and second intake manifolds 6*a* and 6*b*. The pressure sensor 16*a* that is provided in the first intake manifold 6*a* is hereinafter referred to as a first pressure sensor 16*a*, and the pressure sensor 16*b* that is provided in the second intake manifold 6*b* is referred to as a second pressure sensor 16*b*.

The pressure sensors 16*a* and 16*b* are electrically connected to the ECU 20, and output signals from the pressure sensors 16*a* and 16*b* are input to the ECU 20.

The other structure is the same as those in the first embodiment. It should be noted that the number of cylinders, the number of cylinder banks, and their arrangements are not limited to the above configuration described in the fifth embodiment.

According to the configuration in the fifth embodiment, exhaust gas that flows through the first separate exhaust passage 10*a*, that is, exhaust gas that is discharged from the first cylinder bank 2*a* is introduced as EGR gas to the first intake manifold 6*a* through the first EGR passage 21*a*. Meanwhile, exhaust gas that flows through the second separate exhaust passage 10*b*, that is, exhaust gas discharged from the second cylinder bank 2*b* is introduced as EGR gas to the second intake manifold 6*b* through the EGR passage 21*b*.

The opening degree of the first EGR valve 22*a* is adjusted to regulate an amount of the EGR gas that is introduced to the first intake manifold 6*a* through the first EGR passage 21*a*. Meanwhile, the opening degree of the second EGR valve 22*b* is adjusted to regulate an amount of the EGR gas that is introduced to the second intake manifold 6*b* through the second EGR passage 21*b*.

In other words, the amount of the EGR gas that flows into the first and second cylinder banks 2*a* and 2*b* is regulated by respectively adjusting openings of the first and second EGR valves 22*a* and 22*b*. Generally, the openings of the first and second EGR valves 22*a* and 22*b* are adjusted so that the amount of the EGR gas flowing into the first and second cylinder banks 2*a* and 2*b* is optimized for the operating state of the internal combustion engine 1.

However, when the first EGR valve 22*a* is abnormally stuck in the open state, it becomes difficult to regulate the amount of EGR gas that flows into the first cylinder bank 2*a* to a desired amount. In addition, when the second EGR valve 22*b* is abnormally stuck in an open state, it becomes difficult to regulate the amount of EGR gas that flows into the second cylinder bank 2*b* to a desired amount.

Consequently, if the amount of the EGR gas that flows into the first or second cylinder bank 2*a* or 2*b* is excessive for the operating state of the internal combustion engine 1, the combustion state in each cylinder 3 of the corresponding cylinder bank may be affected. If the combustion state in either the first or second cylinder bank 2*a* or 2*b* is affected, the operating state of the internal combustion engine 1 may be destabilized.

For the above reason, in the fifth embodiment, when either the first EGR valve 22*a* or the second EGR valve 22*b* is stuck in an open state, the fuel-cut control is executed in the cylinder bank that includes the EGR passage with the stuck EGR valve, that is, in the cylinder bank with the stuck EGR valve.

Accordingly, combustion is stopped in all the cylinders in the cylinder bank with the stuck EGR valve in which the combustion state may be affected. Therefore, unstable operation of the internal combustion engine 1 may be prevented. It is also possible to prevent emissions of unburned fuel components from the cylinder bank with the stuck EGR valve.

In the fifth embodiment, as in the first embodiment, even if the fuel-cut control is executed in the cylinder bank with the stuck EGR valve, the torque required for the internal combustion engine 1 may be secured by executing compensatory controls, such as by the increasing the fuel injection in the operating cylinder bank. In addition, in the fifth embodiment, even if the fuel-cut control is executed in the cylinder bank with the stuck EGR valve, the EGR gas that flows into the other cylinder bank may be regulated to a desired amount. It is because a separate EGR passage and EGR valve are provided for each the cylinder banks 2*a* and 2*b*.

Figure 9:
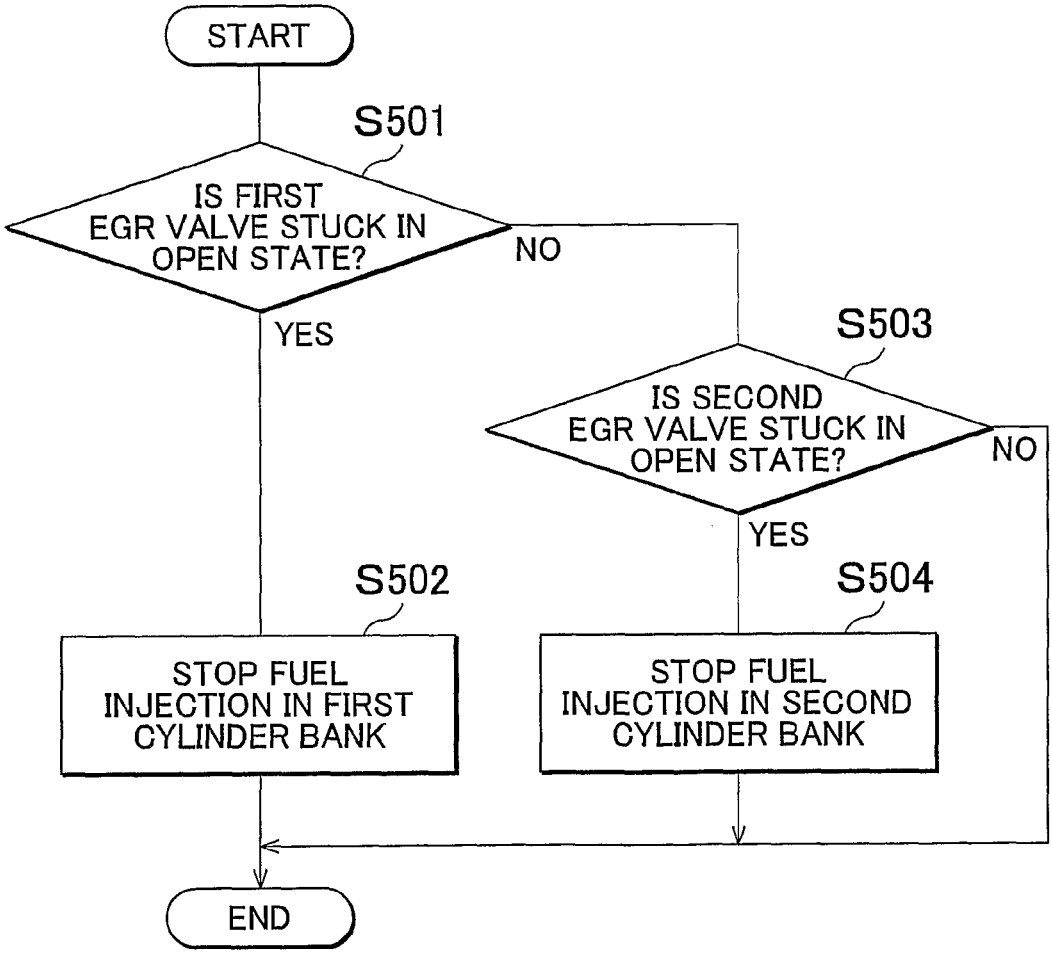
FIG. 9 is a flowchart showing control routine when a first EGR valve or a second EGR valve according to the fifth embodiment is stuck in an open state.

Based on the flowchart shown in FIG. 9, description is now made on control routine that is executed when either the first EGR valve 22*a* or the second EGR valve 22*b* is stuck in an open state in the fifth embodiment. The routine is stored in advance in the ECU 20 and executed repetitively at predetermined intervals during the operation of the internal combustion engine 1.

In step S501 of this routine, the ECU 20 determines whether the first EGR valve 22*a* is stuck in the open state. In this step, the ECU 20 determines whether the first EGR valve 22*a* is stuck in the open state on the basis of the pressure detected by the first pressure sensor 16*a*.

If the EGR valve 22*a* is stuck in an open state, and thus the amount of the EGR gas that flows into the first intake manifold 6*a* becomes larger than the desired amount that is suited for the operating state of the internal combustion engine 1, pressure in the first intake manifold 6*a* becomes higher than that with the desired amount of the EGR gas. Therefore, it is possible to determine whether the first EGR valve 22*a* is stuck in the open state on the basis of the pressure detected by the pressure sensor 16*a*.

If the condition in step S501 is true, the ECU 20 proceeds with the process to step S502, and if the condition is false, the ECU 20 proceeds with the process to step S503.

If the process proceeds to step S502, the ECU 20 stops fuel injection by the fuel injection valves 5 in the first cylinder bank 2*a*. In other words, the fuel-cut control is executed in the first cylinder bank 2*a*. Then, the ECU 20 temporarily ends the routine.

If the process proceeds to step S503, the ECU 20 determines whether the second EGR valve 22*b* is stuck in an open state. In this step, the ECU 20 determines whether the second EGR valve 22*b* is stuck in the open state based on the pressure detected by the second pressure sensor 16*b*. For the same reason as that it is possible to detect whether the first EGR valve 22*a* is stuck in the open state on the basis of the pressure detected by the first pressure sensor 16*a*, it is also possible to detect whether the second EGR valve 22*b* is stuck in the open state on the basis of the pressure detected by the second pressure sensor 16*b*.

If the condition is true in step S503, the ECU 20 proceeds to step S504, and if the condition is false, the ECU 20 temporarily ends the routine.

If the process proceeds to step S504, the ECU 20 stops fuel injection by the fuel injection valves 5 in the second cylinder bank 2*b*. In other words, the fuel-cut control is executed in the second cylinder bank 2*b*. Then, the ECU 20 temporarily ends the routine.

With the control routine that is described above, the fuel-cut control is executed in the cylinder bank with the stuck EGR valve when either the first EGR valve 22*a* or the second EGR valve 22*b* is stuck in the open state.

It should be noted that in the fifth embodiment, the first and second separate exhaust passages 10*a* and 10*b* may be regarded as the separate exhaust passages according to the second aspect of the present invention. In addition, the first and second intake manifolds 6*a* and 6*b* may be regarded as the separate intake passages of the present invention.

The ECU 20 that executes steps S501 and S503 of the control routine in the fifth embodiment when the first EGR valve 22*a* or the second EGR valve 22*b* is stuck in the open state as described above may be regarded as the stuck-open detecting means according to the second aspect of the present invention. In steps S501 and S503, a method other than the above may be used to determine whether the first EGR valve 22*a* or the second EGR valve 22*b* is stuck in an open state. For example, opening sensors may be provided on the first EGR valve 22*a* and the second EGR valve 22*b* to detect the opening degrees of the first EGR valve 22*a* and the second EGR valve 22*b*, and it may be determined whether the first EGR valve 22*a* or the second EGR valve 22*b* is stuck in an open state based on the opening degree detected by the opening sensors. Alternatively, temperature sensors may be provided to detect the temperature in the first and second intake manifolds 6*a*, 6*b*, and it may be determined whether the first EGR valve 22*a* or the second EGR valve 22*b* is stuck in an open state based on the temperature detected by the temperature sensors.

In the fifth embodiment, the ECU 20 that executes steps S502 and S504 of the control routine when the first EGR valve 22*a* or the second EGR valve 22*b* is stuck in the open state as described above may be regarded as the fuel-cut control means according to the present invention.

Furthermore, even if the internal combustion engine 1 is a compression-ignition internal combustion engine (diesel engine), the above-mentioned control may be applied thereto when the first EGR valve 22*a* or the second EGR valve 22*b* is stuck in an open state.

Figure 10:
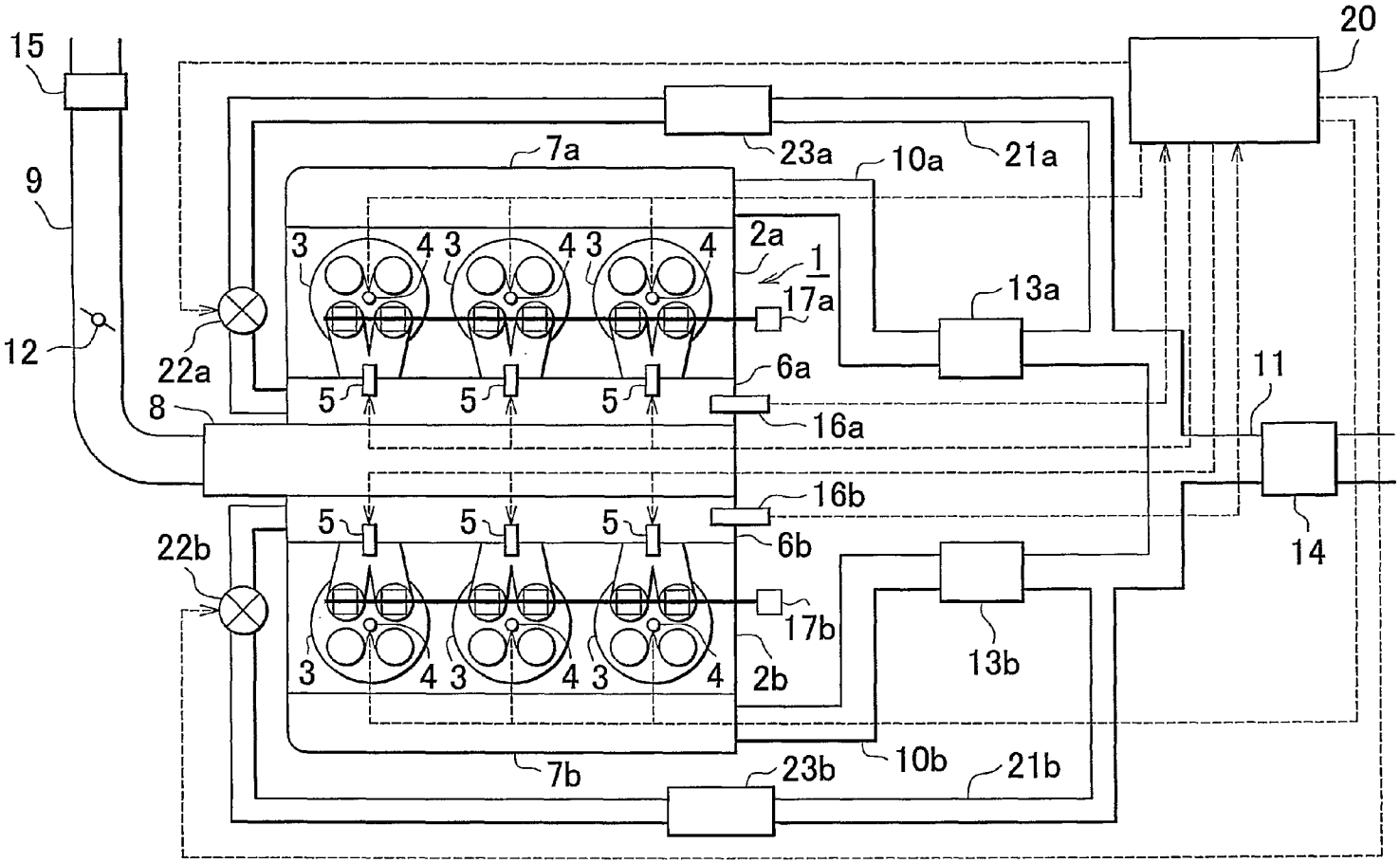
FIG. 10 is a diagram showing a schematic structure of an internal combustion engine and its intake and exhaust systems in accordance with a sixth embodiment of the present invention.

FIG. 10 shows a schematic structure of an internal combustion engine and its intake and exhaust systems in accordance with a sixth embodiment of the present invention. In the internal combustion engine 1 according to the sixth embodiment, first and second valve driving mechanisms 17*a* and 17*b* that are similar to those in the fourth embodiment and that can change valve timing of the intake valves are provided in the first and second cylinder banks 2*a* and 2*b*, respectively. Each valve driving mechanism 17*a* and 17*b* is electrically connected to and controlled by the ECU 20. The other structure is the same as those in the fifth embodiment.

In the sixth embodiment, if the first EGR valve 22*a* or the second EGR valve 22*b* is abnormally stuck in an open state, fuel injection from the fuel injection valves 5 is stopped in the cylinder bank with the stuck EGR valve, and the fuel-cut control is executed therein as in the fifth embodiment.

For example, when the first cylinder bank 2*a* is the cylinder bank with the stuck EGR valve (that is, when the first EGR valve 22*a* is stuck in an open state), the fuel-cut control is executed in the first cylinder bank 2*a*. At this time, the first valve driving mechanism 17*a* closes the intake valves in the cylinders 3 of the first cylinder bank 2*a* and keeps them closed.

Accordingly, it is possible to prevent the air from flowing out of the first cylinder bank 2*a* when the fuel-cut control is executed. If the air is discharged from the first cylinder bank 2*a*, the air may cool the three-way catalysts 13*a* and 14. However, according to the sixth embodiment, such cooling of the three-way catalysts 13*b* and 14 can be prevented.

In addition, because the air is prevented from flowing out of the first cylinder bank 2*a*, it is possible to prevent emissions of contaminants, such as oil, with the air from the first cylinder bank 2*a*. Therefore, it is possible to prevent the contaminants from adhering to the three-way catalysts 13*b* and 14 and from being discharged to the outside.

Furthermore, in the sixth embodiment, when the second cylinder bank 2*b* is the cylinder bank with the stuck EGR valve (that is, when the second EGR valve 22*b* is stuck in an open state), it is possible to prevent cooling of the three-way catalysts 13*b* and 14 as in the case of the first cylinder bank 2*a* being the cylinder bank with the stuck EGR valve. It is also possible to prevent emissions of contaminants, such as oil, with the air from the second cylinder bank 2*b*.

Figure 11:
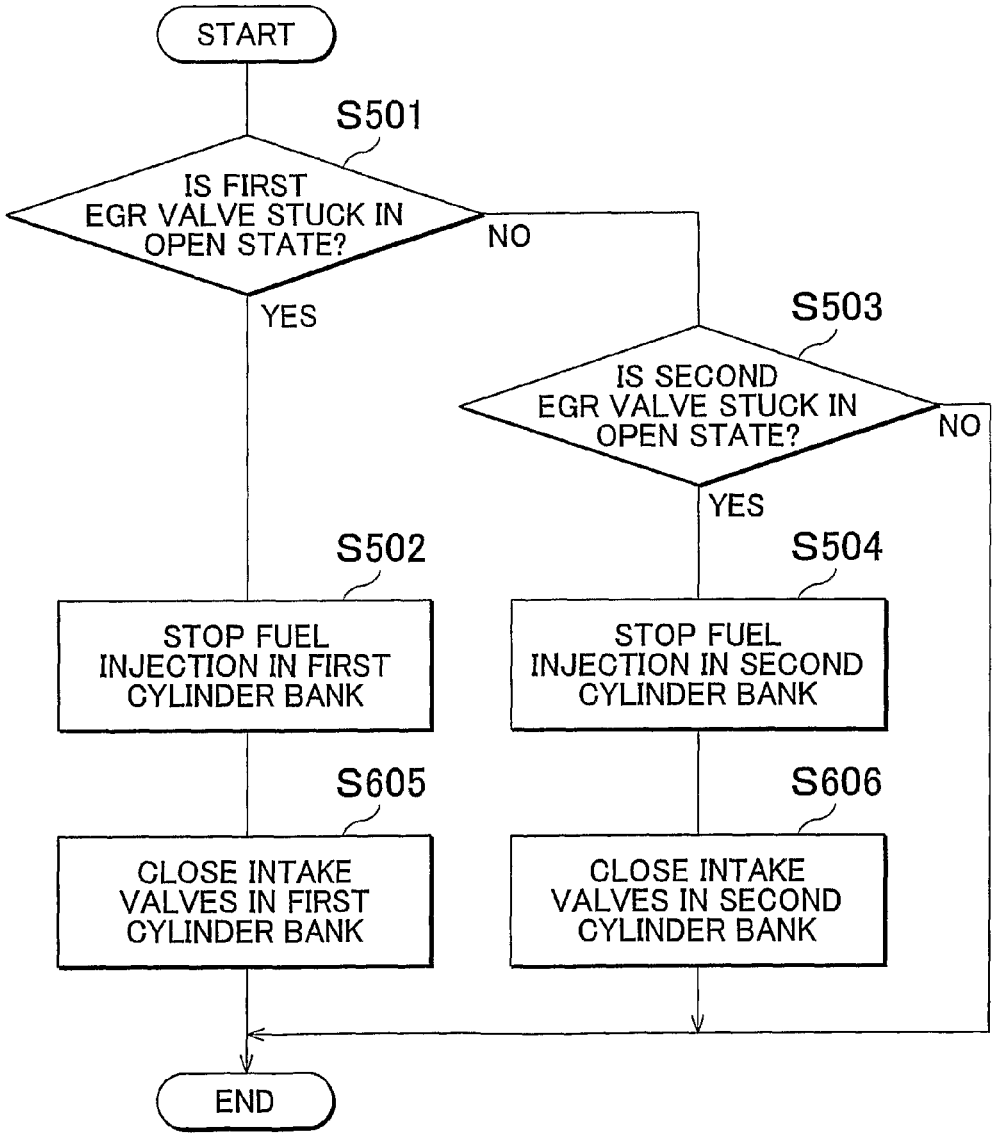
FIG. 11 is a flowchart showing control routine when a first EGR valve or a second EGR valve according to the sixth embodiment is stuck in an open state.

Based on the flowchart shown in FIG. 11, the control routine that is executed when the first EGR valve 22*a* or the second EGR valve 22*b* is stuck in the open state in the sixth embodiment will now be described. The routine is stored in the ECU 20 and executed at predetermined intervals during the operation of the internal combustion engine 1. In the routine, steps S605 to S606 are added to the routine in FIG. 9. Therefore, the steps that are also shown in FIG. 9 will not be described again.

In the routine, after the fuel-cut control is executed in the first cylinder bank 2*a* in step S502, the ECU 20 proceeds to step S605. In step S605, the ECU 20 closes the intake valves in the cylinders 3 of the first cylinder bank 2*a* with the first valve driving mechanism 17*a*. Then, the ECU 20 temporarily ends the routine.

Also in the routine, the ECU 20 proceeds to step S606 after the fuel-cut control is executed in the second cylinder bank 2*b* in step S504. In step S606, the ECU 20 closes the intake valves in the cylinders 3 of the second cylinder bank 2*b* by the second valve driving mechanism 17*b*. Then, the ECU 20 temporarily ends the routine.

The first and second valve driving mechanisms 17*a* and 17*b* in the sixth embodiment may be regarded as the valve operation controlling means according to the second aspect of the present invention. In the sixth embodiment, instead of the first and second valve driving mechanisms 17*a* and 17*b* that change valve timing of the intake valves, a valve driving mechanism that can change valve timing of the exhaust valves may be provided for each cylinder bank 2*a* and 2*b*. Then, the exhaust valves may kept closed in the first cylinder bank 2*a* if the fuel-cut control is executed in the first cylinder bank 2*a*, and the exhaust valves may be kept closed in the second cylinder bank 2*b* if the fuel-cut control is executed in the second cylinder bank 2*b*. In this case, the valve driving mechanisms that change the valve timing of the exhaust valves in the first and second cylinder banks 2*a* and 2*b* may be regarded as the valve operation controlling means according to the second aspect of the present invention.

Also in the sixth embodiment, the valve driving mechanism that changes the valve timing of the exhaust valves may be provided for each cylinder bank 2*a* and 2*b* in addition to the first and second valve driving mechanisms 17*a* and 17*b*, which change the valve timing of the intake valves. Then, both the intake and exhaust valves may be kept closed in the first cylinder bank 2*a* when the fuel-cut control is executed in the first cylinder bank 2*a*, and both the intake and exhaust valves are kept closed in the second cylinder bank 2*b* when the fuel-cut control is executed in the second cylinder bank 2*b*. In this case, the valve driving mechanisms 17*a* and 17*b* that change the valve timing of the intake valves in the first and second cylinder banks 2*a* and 2*b* and the valve driving mechanisms that change the valve timing of the exhaust valves in the first and second cylinder banks 2*a* and 2*b* may be regarded as the valve operation controlling means according to the second aspect of the present invention.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

The invention claimed is:

1. A control system for an internal combustion engine with a plurality of cylinder banks, the control system comprising:

an exhaust passage provided for each cylinder bank of the plurality of cylinder banks, such that each exhaust passage is connected to a respective cylinder bank;

a shared intake passage that is shared by each cylinder bank of the plurality of cylinder banks;

an EGR passage, one end of which is connected to a first exhaust passage and another end of which is connected to the shared intake passage, such that one or more second exhaust passages are not connected to the EGR passage;

an EGR valve that is provided in the EGR passage and regulates a feed rate of EGR gas that is introduced to the shared intake passage;

a stuck-open detecting portion configured to detect whether the EGR valve is stuck in an open state; and a fuel-cut control execution portion configured to execute a fuel-cut control in the cylinder bank that is connected to the first exhaust passage when the stuck-open detecting portions detects that the EGR valve is stuck in an open state, wherein the internal combustion engine is a spark-ignition internal combustion engine that includes a spark plug in each cylinder, and if either an intake valve or an exhaust valve does not remain closed in the cylinder bank that is connected to the first exhaust passage when the fuel-cut control is executed by the fuel-cut control execution portion, a delay angle is set to retard ignition timing of the spark plugs of the other cylinder banks that are connected to the one or more second exhaust passages when the fuel-cut control is executed by the fuel-cut control execution portion.

2. The control system for an internal combustion engine according to claim 1 further comprising an intake air increase amount estimating portion configured to estimate an increase amount of intake air in the cylinder banks that are connected to the one or more second exhaust passages when the fuel-cut control is executed by the fuel-cut control execution portion, wherein the delay angle to retard the ignition timing of the spark plugs in the cylinder banks that are connected to the one or more second exhaust passages is determined based on the estimated increase amount of the intake air that is estimated by the intake air increase amount estimating portion.

3. A control system for an internal combustion engine with a plurality of cylinder banks, the control system comprising:

an exhaust passage provided for each cylinder bank of the plurality of cylinder banks, such that each exhaust passage is connected to a respective cylinder bank;

a shared intake passage that is shared by each cylinder bank of the plurality of cylinder banks;

an EGR passage, one end of which is connected to a first exhaust passage and another end of which is connected to the shared intake passage, such that one or more second exhaust passages are not connected to the EGR passage;

an EGR valve that is provided in the EGR passage and regulates a feed rate of EGR gas that is introduced to the shared intake passage;

a stuck-open detecting portion configured to detect whether the EGR valve is stuck in an open state; and a fuel-cut control execution portion configured to execute a fuel-cut control in the cylinder bank that is connected to the first exhaust passage when the stuck-open detecting portion detects that the EGR valve is stuck in an open state, wherein the internal combustion engine is a compression-ignition internal combustion engine in which a fuel injection valve that directly injects fuel into a cylinder is provided in the cylinder, and if either an intake valve or an exhaust valve does not remain closed in the cylinder bank that is connected to the first exhaust passage when the fuel-cut control is performed by the fuel-cut control execution portion, a delay angle is set to retard fuel injection timing of the fuel injection valves of the other cylinder banks that are connected to the one or more second exhaust passages when the fuel-cut control is executed by the fuel-cut control execution portion.

4. The control system for an internal combustion engine according to claim 3 further comprising an intake air increase amount estimating portion configured to estimate an increase amount of intake air in the cylinder banks that are connected to the one or more second exhaust passages when the fuel-cut control is executed by the fuel-cut control execution portion, wherein the delay angle to retard the fuel injection timing of the fuel injection valves in the cylinder banks that are connected to the one or more second exhaust passages is determined based on the increase amount of the intake air that is estimated by the intake air increase amount estimating portion.

5. The control system for an internal combustion engine according to claim 1 further comprising:

a valve operation controlling portion configured to control operation of at least one of the intake valve or the exhaust valve in the cylinder bank that is connected to the first exhaust passage, wherein the valve operation controlling portion keeps at least one of the intake valve or the exhaust valve closed in the cylinder bank that is connected to the first exhaust passage when the fuel-cut control is executed by the fuel-cut control execution portion.

6. A control system for an internal combustion engine with a plurality of cylinder banks, the control system comprising:

an exhaust passage provided for each cylinder bank of the plurality of cylinder banks, such that each exhaust passage is connected to a respective cylinder bank;

an intake passage provided for each cylinder bank of the plurality of cylinder banks, such that each intake passage is connected to a respective cylinder bank;

an EGR passage provided for each cylinder bank of the plurality of cylinder banks, such that each EGR passage connects the exhaust passage with the intake passages of each corresponding cylinder bank, respectively;

an EGR valve provided in each EGR passage respectively to regulate feed rates of EGR gas flowing into each intake passages, independently;

a stuck-open detecting portion configured to detect whether any of the EGR valves is stuck in an open state; and a fuel-cut control execution portion configured to execute a fuel-cut control in the cylinder banks in which it is determined by the stuck-open detecting portion that the EGR valve of the corresponding EGR passage is stuck in an open state, wherein the internal combustion engine is a spark-ignition internal combustion engine that includes a spark plug in each cylinder, and if either an intake valve or an exhaust valve does not remain closed in the cylinder banks in which it is determined by the stuck-open detecting portion that the EGR valve of the corresponding EGR passage is stuck in an open state when the fuel-cut control is executed, a delay angle is set to retard ignition timing of the spark plugs of the other cylinder banks in which it is not determined by the stuck-open detecting portion that the EGR valve of the corresponding EGR passage is stuck in an open state when the fuel-cut control is executed.

7. The control system for an internal combustion engine according to claim 6 further comprising a valve operation controlling portion configured to respectively control operation of at least one of the intake valve or the exhaust valve in the cylinder banks, wherein the valve operation controlling portion keeps at least one of the intake valve or the exhaust valve closed in the cylinder banks in which the EGR valve of the corresponding EGR passage is determined as stuck in an open state when the fuel-cut control is executed by the fuel-cut control execution portion.

8. A control method for a spark-ignition internal combustion engine that includes:

a spark plug provided in each cylinder;

a plurality of cylinder banks;

an exhaust passage provided for each cylinder bank of the plurality of cylinder banks, such that each exhaust passage is connected to a respective cylinder bank;

a shared intake passage that is shared by each cylinder bank of the plurality of cylinder banks;

an EGR passage, one end of which is connected to a first exhaust passage and another end of which is connected to the shared intake passage, such that one or more second exhaust passages are not connected to the EGR passage; and an EGR valve that is provided in the EGR passage and regulates a feed rate of EGR gas drawn into the shared intake passage, comprising:

determining whether the EGR valve is stuck in an open state;

executing a fuel-cut control in one of the plurality of cylinder banks that is connected to the first exhaust passage when it is determined that the EGR valve is stuck in an open state;

setting a delay angle to retard ignition timing of the spark plugs of the other cylinder banks that are connected to the one or more second exhaust passages when the fuel-cut control is executed, if either an intake valve or an exhaust valve does not remain closed in the cylinder bank that is connected to the first exhaust passage when the fuel-cut control is executed.

* * * * *